United States Patent [19]

Rubin

[11] Patent Number: 5,064,547

[45] Date of Patent: Nov. 12, 1991

[54] LUBRICANT COMPOSITIONS FOR METALS CONTAINING DICARBOXYLIC ACIDS AS A MAJOR CONSTITUENT

[75] Inventor: David Rubin, San Diego, Calif.

[73] Assignee: Century Laboratories, Incoporated, Port Washington, N.Y.

[21] Appl. No.: 581,621

[22] Filed: Sep. 12, 1990

[51] Int. Cl.[5] ..... C10M 105/22; C10M 105/26

[52] U.S. Cl. ..... 252/56 R; 252/565; 252/49.6

[58] Field of Search ..... 252/56 R, 56 S, 49.6

[56] References Cited

U.S. PATENT DOCUMENTS

| | | | |
|---|---|---|---|
| 2,347,562 | 4/1944 | Johnston | 260/410.9 R |
| 2,793,220 | 5/1957 | Barrett et al. | 260/407 |
| 3,719,600 | 3/1973 | Bosniack et al. | 252/56 R |
| 4,042,515 | 8/1977 | van Zalm | 252/56 R |
| 4,228,217 | 10/1980 | Baur | 252/56 R |
| 4,274,973 | 6/1981 | Stanton et al. | 252/56 R |
| 4,382,009 | 5/1983 | Maeda | 252/56 R |

*Primary Examiner*—Prince E. Willis
*Assistant Examiner*—J. Silbermann
*Attorney, Agent, or Firm*—Browdy and Neimark

[57] ABSTRACT

Lubricating compositions are provided which comprise from about 60 to about 80% by weight of at least one saturated dicarboxylic acid, and from about 20 to about 40% of a carrier for said dicarboxylic acid. The lubricating compositions are particularly well suited for use in metal-to-metal lubricating, and are particularly useful in automobile engine lubrication.

3 Claims, No Drawings

LUBRICANT COMPOSITIONS FOR METALS CONTAINING DICARBOXYLIC ACIDS AS A MAJOR CONSTITUENT

FIELD OF THE INVENTION

The prevent invention relates to compositions for lubricating metals.

BACKGROUND OF THE INVENTION

The primary purpose of a lubricant is to separate moving surfaces to minimize friction and wear. The first known example of lubrication is the use of tallow to lubricate chariot wheels. Although Leonardo daVinci discovered the fundamental principles of friction and lubrication, widespread understanding of the science of lubrication did not develop until the latter part of the nineteenth century.

Lubrication can be effected by several different methods, ranging from complete separation of moving surfaces by a fluid lubricant, through partial separation in boundary lubrication, to dry sliding where solid material properties and surface chemistry dominate.

In fluid-film lubrication, the load is supported entirely by pressure within the separating-fluid film. This film pressure is frequently generated by the relative motion of the surfaces involved, which pumps the lubricant into a converging, wedge-shaped zone.

As the operating conditions become more severe, a point is eventually reached where the oil-film support can no longer carry the load completely. High spots, or separation, of the mating surfaces then must share in load support with the lubricant, and the lubrication shifts from full-film, with a coefficient of friction of about 0.001, to mixed-film, to complete boundary lubrication wherein the coefficient of friction increases to 0.1–0.3. This shift from full-film to boundary lubrication may result from any one or a combination of the following conditions: high load, low speed, low viscosity lubricant, misalignment, high surface roughness, or inadequate supply of lubricant. With boundary lubrication, chemical additives in the lubricating oil and chemical, metallurgical, and mechanical factors involving the two rubbing surfaces determine the extent of wear and the degree of friction.

Under boundary conditions of lubrication, metal contact through the oil film results in junctions of asperities and subsequent metal tearing on a microscopic scale. With increasing loads, more of these contacts occur, resulting in more plastic deformation, higher temperatures, and welding. Seizure eventually occurs on a gross and devastating scale. Hyped gears, such as in automobile differentials, are particularly susceptible to this type of damage, since these gears impose severe sliding conditions in combination with high contact stress. The intense heat leads to very high surface temperatures and ineffectiveness of the organic lubricant film that normally is present. Extreme pressure lubricants have been developed to deal with these conditions, which lubricants contain additives that react at the high contact temperatures to form low melting, inorganic lubricant films on the metal surfaces and thereby prevent massive welding and breakdown. These additives generally consist of sulfur, chlorine, phosphorus, and lead compounds that act either by providing layers of low shear strength to minimize metal tearing of by serving as fluxing agents that contaminate the metal surface and prevent welding. Because these extreme pressure additives are effective only by chemical action, use of these additives should generally be avoided to minimize possible corrosion difficulties in any apparatus where they are not strictly necessary.

Lubricating oils from petroleum generally consist of complex mixtures of hydrocarbon molecules. These generally range from low viscosity oils with molecular weights as low as 250 to very viscous lubricants with molecular weights as high as about 1,000. The physical properties of the lubricating oils, such as viscosity, viscosity-temperature-pressure characteristics, and performance, depend largely on the relative distribution of paraffinic, aromatic, and alicyclic (naphthenic) components.

For a given molecular size, the paraffins have relatively low viscosity and density and higher freezing points as compared to the other types of petroleum lubricants. Paraffinic oils have low oxidation resistance unless properly inhibited, in which case they have high stability with little tendency for sludging. Although the aromatic compounds are relatively stable to oxidation, they form insoluble black sludges at high temperatures. Aromatic oils also change viscosity rapidly with temperature, high density, and a darker color. Alicyclic oils have a low pour point, a low order of oxidation stability, and other physical properties that are intermediate those of the paraffins and aromatics. Almost all of the oils called paraffinic oils are composed of both paraffinic and alicyclic structures, with only a minor proportions of aromatics. When stabilized with an oxidation inhibitor, alicyclics offer non-sludging oils that are satisfactory for almost any type of lubricating purpose.

When petroleum crude oils are distilled, the lower boiling gasoline, kerosenes, and fuel oils are removed first, and the lubricating-oil fractions are divided by boiling point range into several grades of neutral distillates and a more viscous residue sometime called a cylinder stock. Subsequent refining steps remove undesirable aromatics and the minor proportion of sulfur, nitrogen, and oxygen compounds present. Hydrogen treatment at high pressure and in the presence of a catalyst has become the most popular refining method. Very mild hydrofining primarily involves removal of color and some nitrogen and sulfur compounds, whereas severe hydrofining or hydrocracking alters the chemical structures to convert aromatics to paraffins and alicyclics.

Low temperature filtration is often used to remove paraffin wax and thereby decrease the pour point of the oil. Lubricating oils are made by blending one or more refined oil stocks of the desired viscosity with the additives required for the expected service conditions.

In recent years, the evolution and technical progress in all types of internal combustion engines have led to higher and higher horsepower and greater efficiency. The lubricants used in these engines must form a stable and oily film, which at low temperatures will facilitate starting of the engine even in cold weather. Additionally, these lubricants must perform well at the higher operating temperatures of the newer engines in order to avoid piston fouling, ring groove plugging and lacquering, deposit formation, and the like, which lead to a drastic reduction of power output and often results in expensive damage to the engine. Furthermore, the exhaust gases resulting from fuel combustion together with a part of the lubricant must be clean and have a minimum of odors.

The addition of small amounts of certain materials to natural and synthetic lubricating oils to modify their properties in desirable ways is well known to those skilled in the art.

Turbine oils are the primary products used for circulating systems, and are the common choice for steam turbines, steel mills, paper ills electric motors, and hydroelectric generators. These oils commonly contain rust and foam inhibitors, and an oxidation inhibitor to extend the life of the oil. Hydraulic oils are developed for general use in hydraulic mechanisms and circulating systems characteristic of factory machine tools. They commonly contain a zinc dithiophosphate additive to minimize wear in high pressure hydraulic pumps. General purpose oils with no additives are used to control expenses in once-through lubrication, and can be applied by mist, drip feed, and the like in factory machines.

For gears, the SAE automotive lubricants classified between 5W and 50W are generally used for both automotive and industrial applications. Industrial gears generally use the American Gear Manufacturers Association grades of 2EP through 8A EP. These contain a variety of sulfur, phosphorus, chlorine, lead, and tallow-type additives to minimize scuffing and wear.

Most high quality oils contain organic compounds containing sulfur, nitrogen, phosphorus, and/or alkylphenols to retard the oxidation of the oils. Oil oxidation is a chain reaction involving oxygen from the air in hydroperoxide formation which leads to the formation of organic acids and other oxygenated products. Added inhibitors and some naturally occurring aromatic petroleum components appear to interrupt the chain reaction by combining with the hydroperoxide; this action delays formation of varnish, sludge, and acids for extended operating periods and minimizes corrosion problems with lead, zinc, cadmium, and copper-containing alloys which are corroded by organic acids in oxidized oils.

Rust inhibitors are surfactant materials that are preferentially adsorbed as a film on iron and steel surfaces to protect them from attacks by moisture. For mild conditions where a small amount of water is present in a large quantity of circulating oil, mildly polar organic acid, such as alkyl-succinic acids, and organic amines are often used. For the severe conditions encountered in shipping machinery, in extended storage, or in outdoor weather, more strongly adherent organic phosphate, polyhydric alcohols, and sodium and calcium sulfonates are used. When incorporated in vapor-space inhibited oils, cyclohexylamine and related amines with modest vapor pressure provide rust protection above the oil level during extended shutdown periods.

Antiwear agents are used to produce a surface film by either a chemical or physical adsorption mechanisms to minimize friction and wear under boundary-lubrication conditions. The compounds used for improved lubrication under boundary-film conditions are compounds containing oxygen, such as fatty acids, ester, and ketones; compounds containing sulfur or combinations of oxygen and sulfur, organic chlorine compounds such as chlorinated wax; organic sulfur compounds such as sulfurized fats and sulfurized olefins; compounds containing both chlorine and sulfur; organic phosphorus compounds such as tricresyl phosphate, thiophosphates, and phosphites; and organic lead compounds.

For extreme rubbing conditions where severe metal-to-metal contact is encountered, active sulfur, chlorine, and lead compounds have traditionally been used. In localized metallic contacts of high spots on the rubbing surfaces, these additives react to form low shear strength surface layers, such as lead sulfide, iron chloride, or iron sulfide. The surface layer prevents destructive welding, excessive metal transfer, and severe surface breakdown. Automotive hyped gears, slideways of machine tools, and various metal-cutting operations are representative of the types of application for these extreme pressure lubricants.

Oil detergents are conventionally used at concentrations of about 2–20% by weight to prevent high temperature deposits on internal combustion engine parts of oil-insoluble sludge, varnish, carbon, and lead compounds. The detergents act by adsorbing on insoluble particles, thereby maintaining them as a suspension in the oil to minimize deposits and to maintain cleanliness of rings, valves, and cylinder walls. Dispersants serve the same function in engines that are operated at relatively low engine temperatures that occur in short trips and in stop-and-go driving. Among the detergents that are in substantially commercial use are sulfonates, the calcium and barium salts of petroleum mahogany sulfonic acids and long-chain, alkyl-substituted aromatic sulfonic acid; phosphonates and thiophosphonates; polyolefins of about 500–2,000 molecular weight reacted with phosphorus pentasulfide and conversion of the resulting thiophosphonic acid to an alkaline earth metal salt; phenolates, calcium and barium salts of alkyl phenols, alkylphenol sulfides, and alkylphenol-aldehyde condensation products; and calcium and zinc alkyl-substituted salicylates.

Ashless dispersants are used to prevent formation of cold sludge in gasoline engines under stop-and-go driving conditions. Among these dispersants are reaction products of alkylsuccinic anhydrides with amines; polybutene treated with P2S5, steam, and ethylene oxide; polymers containing oxygen-or nitrogen-bearing comonomers, such as alkyl methacrylate-dimethylaminoethyl methacrylate copolymers, alkyl methacrylate-N-vinylpyrrolidone copolymers, and vinyl acetate-dialkyl fumarate-maleic anhydride copolymers.

A number of prior workers have sought to provide lubricating compositions which lubricate while protecting the metallic parts to be lubricated. All of these prior compositions have been based primarily on lubricating oils per se.

Barnum, in U.S. Pat. No. 2,369,740, discloses an anticorrosive for incorporation into a neutral vehicle such as normally liquid or normally solid hydrocarbons, alcohols, esters, and the like, comprising a dicarboxylic ether acid having at least 6 carbon atoms. Although these materials are anticorrosive, there is no indication that they are lubricating compositions in themselves. Moreover, the dicarboxylic ether acids are incorporated into the carriers in amounts ranging from about 0.001% to about 5% by weight.

Watkins, in U.S. Pat. No. 2, 292,308, discloses compounded lubricating oil compositions consisting essentially of a petroleum lubricating oil and a metal salt of an alkyl mono-ester of an alkenyl substituted succinic acid, or a mixture of a normal and a basic metal salt of an alkyl monoester of an alkenyl substituted succinic acid. These esters and salts are added to the lubricating oil in amounts ranging from about 0–0.5% to about 3% by weight of the oil, or even higher.

Bosniack et al, in U.S. Pat. No. 3,719,600, disclose a lubricant composition comprising a lubricating oil and a corrosion inhibiting amount of a polycarboxylic acid containing at least four non-carboxylic carbon atoms and more than two carboxyl groups. The polycarboxylic acids are present in amounts generally ranging from about 0.001 to about 1.0 parts acid per 100 parts by weight of oil.

Souillard et al, in U.S. Pat. No. 3,953,179, disclose lubricating compositions for two-stroke internal combustion engines comprising 90 to 97% by weight of a lubricant mixture comprising 15 to 80% by weight of a polymer selected from the group consisting of hydrogenated and non-hydrogenated polybutene, polyisobutylene, and mixtures thereof, with a mean molecular weight ranging from 250 to 2,000, and 0.5 to 10% by weight of a triglyceride of an unsaturated aliphatic carboxylic acid containing 18 carbon atoms, and the remainder being a lubricating oil, and 3 to 10% by weight of conventional lubricating oil additives for two-stroke engines.

SUMMARY OF THE INVENTION

It is an object of the present invention to overcome the aforesaid deficiencies in the prior art.

It is another object of the present invention to provide improved compositions for lubricating metals.

It is a further object of the present invention to provide improved compositions for lubricating automobile engines.

According to the present invention, lubricating compositions are based upon $C_6$-$C_{32}$ dicarboxylic acids dispersed or dissolved in a suitable carrier. When in contact with metallic surfaces, the carboxyl groups of the acids accept electrons from the metallic surfaces and provide a continuous coating of the metal surfaces even under conditions of high friction. When the carboxyl groups of the dicarboxylic acid accept electrons from the metal surface, the dicarboxylic acid molecule is bound to the metal surface with the methylene groups of the acid molecule separating the metallic surfaces from each other. The paraffinic methylene groups provide excellent lubrication between the metallic parts, and friction is thus substantially reduced.

The dicarboxylic acids used in the present invention are saturated dicarboxylic acids, because the double bonds of unsaturated acids may be polymerized and/or oxidized at the operating temperatures of internal combustion engines.

The compositions of the present invention comprise from about 60 to about 80% of saturated dicarboxylic acid by weight, and from about 40 to about 20% a carrier such as of paraffin oil or other suitable carrier by weight of the composition. Preferably, the lubricating compositions of the present invention comprise from about 70 to about 80% by weight of saturated dicarboxylic acid and from about 20 to about 30% by weight of carrier.

The viscosity of the lubricating compositions is controlled by the chain length of the dicarboxylic acids used; the longer the chain length, the more viscous the oil. The compositions of the present invention may include mixtures of dicarboxylic acids in any proportions required to obtain the desired viscosity and lubricating characteristics.

The lubricating compositions of the present invention are particularly valuable for their corrosion inhibiting properties, as the carboxyl groups of the acid bond with the metallic surfaces with which they are in contact, protecting the metallic surfaces from contact with oxygen or other harmful molecules. The exact mechanisms of this antioxidation is not entirely clear.

In addition to their antioxidant properties, the dicarboxylic acids provide another mechanism for protecting the engines which they lubricate. When these dicarboxylic acids are degraded by heat, they are decarboxylated, leaving paraffin and carbon dioxide. The carbon dioxide produced by this decarboxylation saturates the lubricant composition with carbon dioxide, which carbon dioxide displaces any oxygen in the lubricant compound. Thus, even when the dicarboxylic acids are degraded by engine heat, this degradation serves to saturate the lubricant composition and the metals of the engine with carbon dioxide, which provides further protection for the metal.

Another advantage of the compositions of the present invention is of particular importance when the lubricating compositions are used in automobile engines, as the compositions provide improved heat transfer within the engine cylinders. Additionally, the efficiency of the engine is improved because the dicarboxylic acids provide a better seal in the cylinder. Because of the better seal in the cylinder, less gas leaks from the cylinder.

The lubricants of the present invention also provide protection in the event of leakage of the oil from the engine, since much of the lubricant is bound to the metallic surfaces and will not leak out of the engine. This is particularly useful in combat situations, when the lower part of the engine is damaged, the engine will not immediately seize or freeze because of friction. The lubricating composition of the present invention remains in contact with the metallic surfaces for a much longer time than conventional paraffinic lubricants.

DETAILED DESCRIPTION OF THE INVENTION

Lubricating compositions according to the present invention include from about 40 to about 80% by weight of at least one saturated dicarboxylic acid having from about 6 to about 32 carbon atoms, and from about 20 to about 40% by weight of a suitable carrier for the dicarboxylic acid.

The dicarboxylic acids, also known as dimer acids, are products resulting from three different reactions of unsaturated fatty acids. These reactions are self-condensation, Diels-Alder reaction with acrylic acid, and reaction with carbon monoxide followed by oxidation of the resulting 9- or 10-formyl stearic acid (or, alternatively, hydrocarboxyliation of the unsaturated fatty acid). The starting materials for these reactions are generally tall oil fatty acids or oleic acid, although other unsaturated fatty acid feedstocks can be used.

Dimer acids are relatively high molecular weight, around 560, yet they are generally liquid at 25° C. because of the many isomers present. Different precursors for dimeric acid preparation give quite different structures.

The clay-catalyzed intermolecular condensation of oleic and/or linoleic acid on a commercial scale produces approximately a 60:40 mixture of dimer acids (C36 and higher polycarboxylic acids) and monomer acids (C18 cyclized, aromatized, and isomerized fatty acids). The polycarboxylic acid and monomer fractions are usually separated by wiped-film evaporation. Methods of preparation of these acids are disclosed more fully in British Patent 121,777 (1918), British patent 127,814 (1919), and the following U.S. Pat. Nos.:

2,347,562 Johnston 2,793,220 Barrett et al.

The above patents are hereby incorporated by reference.

The carriers for the dicarboxylic acids in the present invention include conventional paraffinic oils as well as synthetic oils. The lubricating oils may include normal paraffins, isoparaffins, cycloparaffins, aromatic hydrocarbons, and hydrocarbons with mixed aliphatic chains and aromatic rings.

Alternatively, synthetic oils may be used as the carriers for the dicarboxylic acids. These synthetic oils include organic esters such as $ROOC(CH_2)_nCOOR$ that have been derived from $C_6$-$C_{10}$ acids that have been esterified with $C_6$-$C_9$ branched-chain alcohols. A widely used diester fluid for synthetic lubricants is di(2-ethylhexyl)sebacate. Because the dicarboxylic acids of the present invention act as corrosion inhibitors when in contact with metal surfaces, there is no need for additional corrosion inhibitors in the lubricant formulations. Because these diesters have relatively low viscosities, they can conveniently be used with the longer-chain dicarboxylic acid, i.e., those dicarboxylic acids having more than 20 carbon atoms.

For very high temperatures and severe load situations, particularly in jet engines, higher viscosity polyesters can be used as the carriers for the dicarboxylic acids. Triesters based on trimethylolpropane as well as fluids based on pentaerythritol can readily be used with the dicarboxylic acids to provide lubricants according to the present invention.

Synthetic hydrocarbons are prepared by polymerizing isobutylene (containing some 1-butene and 2-butene), which is available in large volumes from petroleum cracking. Polyisobutylene oils range in molecular chain size of from about 20 to more than 100 carbon atoms. As compared with petroleum oils of similar viscosity, the polyisobutylenes are lighter in color, have superior electrical properties, and have lower pour points. When used as carriers for the dicarboxylic acid lubricants, they are useful in high temperature operations, such as ovens, dryers, and furnaces.

Polymers of various other alpha olefins and of ethylene can also be used as carriers for the dicarboxylic acids. For extremely cold weather, alkylated benzenes are used as carriers for lower molecular weight dicarboxylic acids, i.e., acids having from about 6 to about 12 carbon atoms.

Where enhanced fire resistance is desired, phosphate esters can be used as carriers for the dicarboxylic acids. These phosphate esters have the general formula $OP(OR)_3$, wherein R is aryl, alkyl, or a variety of other groups having from 1 to about 10 carbon atoms. The lubricants in which phosphate esters are the carriers are particularly useful as fire-resistant lubricants in die-casing machines and for other metal processing equipment, as aircraft hydraulic fluids, in lubrication of air compressors and industrial gas turbines, and in a variety of naval and industrial hydraulic systems where fire resistance is required.

Other synthetic fluids which can be used as carriers for the dicarboxylic acids according to the present invention include polypnenyl ethers, such as $C_6H5$-$(OC_6H4$-$)nOC_6H5$; silicate esters, $Si(OR)_4$, such as tetraethyl silicate, tetra (2-ethylhexyl) silicate, tetra(2-ethylbutyl) silicate, and silicate dimers such as hexa(2-ethylbutoxy) disiloxane; fluorochemicals such as poly(-chlorotrifluoroethylene), copolymers of perfluoroethylene, and perfluoropropylene.

Additionally, lubricating compositions can be formulated as greases, or thickened lubricating oils. Traditionally, greases are merely lubricating oils that are thickened with a gelling agent such as a soap, although in the present invention the viscosity or thickness of the lubricating composition can be controlled by controlling the molecular weight of the dicarboxylic acid used in the composition. The higher the molecular weight (i.e, the more carbon atoms) of the dicarboxylic acid, the higher the viscosity of the resultant composition.

For formulating grease-type lubricants according to the present invention, the high molecular weight (generally above 24 carbon atoms) dicarboxylic acids are mixed with a petroleum oil which ranges from SAE 20 to SAE 30. Although oils derived from many types of crudes and refined by widely different processes can be used for making greases according to the present invention, less highly refined oils and the alicyclic types of oils are the most widely used for this purpose.

Oils which can be used as carriers for dicarboxylic acids to provide lubricating compositions according to the present invention are fluorocarbons, polyethers, and polysilicones.

The following nonlimiting examples are provided better to illustrate the invention.

EXAMPLE I

A lubricating composition is prepared from the following:

60% by weight of a mixture of $C_8$-$C_{20}$ dicarboxylic acids.

20% mineral oil (75SSU at 100° F.)

EXAMPLE II

A lubricating composition is prepared from the following ingredients:

20% di(2-ethylhexyl) sebacate

40% $C_6$-$C_{12}$ dicarboxylic acids

40% $C_{12}$-$C_{24}$ dicarboxylic acids.

EXAMPLE III

A tire resistant lubricating composition is prepared from the following:

35% triethyl phosphate ester

65% mixture of $C_{20}$-$C_{32}$ dicarboxylic acids.

As an illustration of the efficacy and longevity of the lubricant of the present invention, a composition according to Example 1 was added to an automobile engine and was then drained out. The engine was permitted to run in this drained condition, and the engine ran for one hour and twenty minutes before the temperature of the engine increased.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. Lubricating compositions comprising from about 60 to about 80% by weight of at least one saturated dicarboxylic acid "having from about 6 to about 32 carbon atoms", and from about 20 to about 40% of a carrier for said dicarboxylic acid, said carrier being selected from the group consisting of paraffin oils, silicone oils, organic ester oils, polyglycol oils, synthetic hydrocarbons and mixtures thereof.

2. Lubricating compositions according to claim 1 in the form of a grease comprising a mixture of $C_{20}$-$C_{32}$ dicarboxylic acids and a mineral oil carrier.

3. Lubricating compositions according to claim 1 wherein said organic ester oils are selected from the group consisting of triphosphate esters and polyphenyl ethers.

* * * * *